US006293252B1

(12) United States Patent
Niethammer et al.

(10) Patent No.: US 6,293,252 B1
(45) Date of Patent: Sep. 25, 2001

(54) FUEL INJECTION DEVICE FOR INTERNAL COMBUSTION ENGINES

(75) Inventors: Bernd Niethammer, Nürtingen; Martin Lenk, Chemnitz; Steffen Martin, Niederfrohna, all of (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/450,518

(22) Filed: Nov. 29, 1999

(30) Foreign Application Priority Data

Apr. 14, 1999 (DE) ..... 199 16 657

(51) Int. Cl.[7] ..... F02M 7/00
(52) U.S. Cl. ..... 123/447; 123/446
(58) Field of Search ..... 123/446, 447, 123/458, 500, 501, 467

(56) References Cited

U.S. PATENT DOCUMENTS 4,633,836 * 1/1987 Faupel ..... 123/467
5,685,272 * 11/1997 Paul et al. ..... 123/446
5,826,562 * 10/1998 Chen et al. ..... 123/446
5,862,792 * 1/1999 Paul et al. ..... 123/446
5,950,601 * 9/1999 Nemoto et al. ..... 123/495
5,954,030 * 9/1999 Sturman et al. ..... 123/446
6,029,628 * 2/2000 Oleksiewicz et al. ..... 123/446
6,065,450 * 5/2000 Chen et al. ..... 123/446
6,085,726 * 7/2000 Lei et al. ..... 123/446

* cited by examiner

*Primary Examiner*—Carl S. Miller
(74) *Attorney, Agent, or Firm*—R. W. Becker & Associates; R. W. Becker

(57) ABSTRACT

The invention relates to a fuel injection device for internal combustion engines, preferably Diesel engines. The device has at least one control valve by means of which a control piston is displaceable by a pressure medium in order to convey fuel through at least one channel toward a combustion chamber of the internal combustion engine. The device has at least one accumulator for the pressure medium disposed in a flow direction of the pressure medium, whereby the accumulator is provided within the control piston.

16 Claims, 4 Drawing Sheets

FUEL INJECTION DEVICE FOR INTERNAL COMBUSTION ENGINES

BACKGROUND OF THE INVENTION

The present invention relates to a fuel injection device for internal combustion engines, preferably Diesel engines, with at least one control valve by means of which a control piston is displaceable by a pressure medium in order to convey fuel through at least one intake line toward a combustion chamber of the internal combustion engine.

For a reliable and clean mixture formation, internal combustion engines, Diesel engines in particular, require an injection process consisting of several individual injection actions. The injection processes are divided into pre-injection and main injection of the fuel quantity. For producing the pre-injection fuel quantity, a control unit is employed which requires a high-cost electronic control system and which shows energetic losses. Frequently, a damper is employed for producing the pre-injection fuel quantity. This damper, however, cannot be fully utilized in each step of the operation. The reason for this is that the response time of the control hydraulic is too long in the event of small injection quantities due to the design of the control elements and a small pre-injection quantity can, therefore, be produced only with the help of a significant control-technical structural design and expenditure.

Therefore, it is an object of the present invention to provide a fuel injection device of the aforementioned kind such that a small pre-injection quantity can be produced with the fuel injection device having a simple structural design and only requiring a small control-technical expenditure and design without having a detrimental effect on the pressure flow of the main injection and, thus, on the main injection quantity.

SUMMARY OF THE INVENTION

This object is solved by the inventive fuel injection device by providing at least one accumulator for the pressure medium in the flow path of the pressure medium and arranging this accumulator within the control piston.

BRIEF DESCRIPTION OF THE DRAWINGS

The object and advantages of the present invention will appear more clearly from the following specification in conjunction with the accompanying schematic drawings in which.

DESCRIPTION OF PREFERRED EMBODIMENTS

Figure 1:
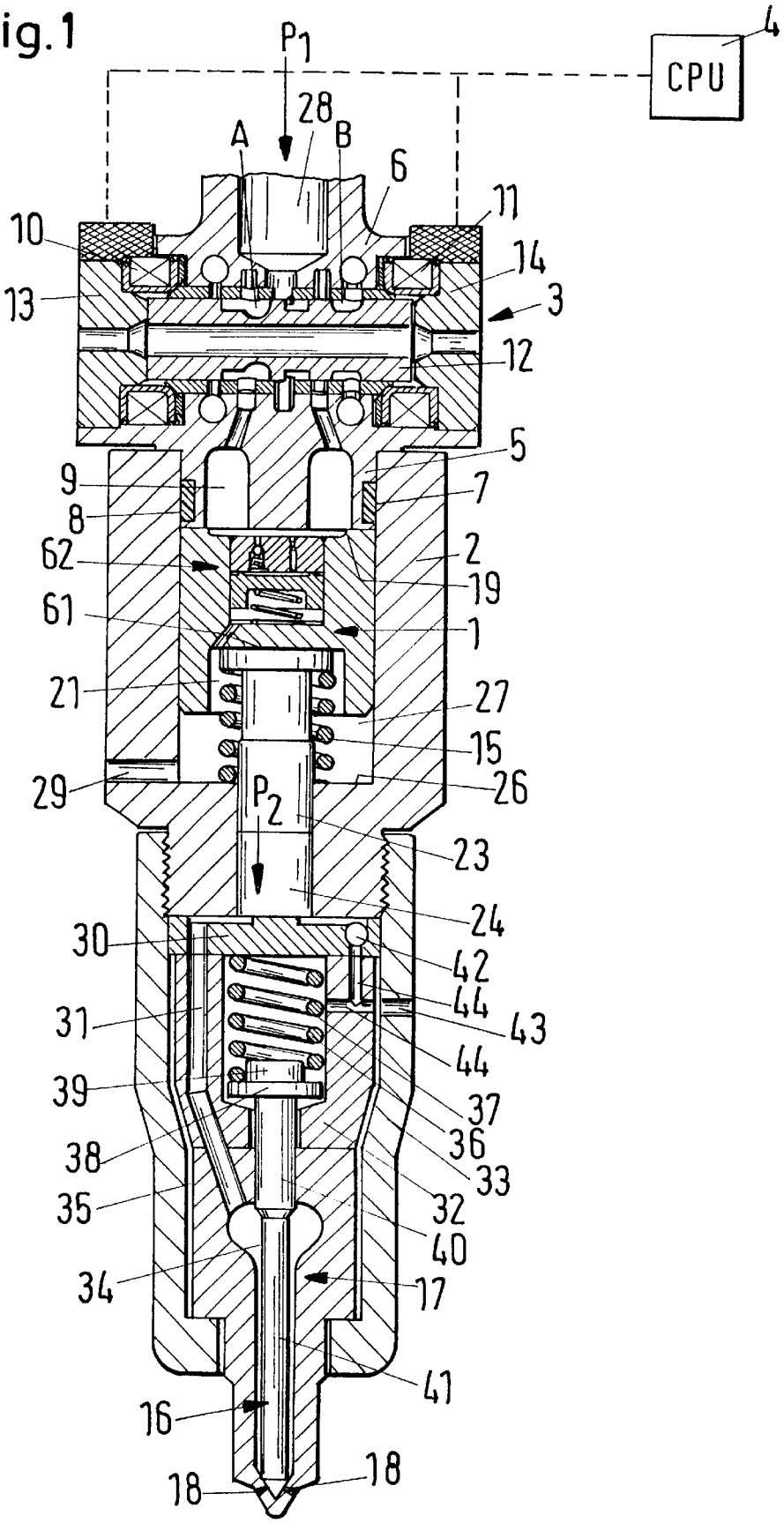
FIG. 1 shows a longitudinal section of an inventive fuel injection device.

The present invention will now be described in detail with the aid of several specific embodiments utilizing FIGS. 1 through 4.

The fuel injection device is utilized in motor vehicles and its purpose is to supply fuel to a internal combustion engine, a Diesel engine, in particular. The fuel injection device has a control piston 1 which is provided in a housing 2. The pressure medium is supplied to the control piston 1 by a control valve 3 which is embodied as a pilot valve and is connected to a control unit 4. The control valve 3 is disposed on the housing 2 and projects with a projection 5 of a valve body 6 into a recess 7 provided at the end face of the housing 2. At least one annular seal 8 is provided at the external wall of the projection 5 and seals the projection 5 against the housing 2. An annular cavity 9 is provided within the projection 5 and is line-connected to the working connections A, B of the control valve 3. The control valve 3 is controlled and monitored by the control unit 4. Coils 10, 11 of the control valve 3 can be supplied with current by means of the control unit 4. A piston member 12 of the control valve 3 is embodied as an anchor and can be displaced by the coils 10, 11 in the desired direction. The piston member 12 is axially displaceable between two stops 13, 14 which are provided at the end face of the control valve 3 and are inserted into the end face of the valve body 6.

If the control valve 3 is closed, the control piston 1 abuts the projection 5 ofthe valve body 6 under the force of a compression spring 15. The control piston 1 is illustrated in its starting position, displaced by the spring 15, in which a valve body 16 of an injection valve 17 closes off nozzle openings 18 by means of which the fuel is fed to the combustion chamber of the internal combustion engine (not illustrated).

The control piston 1 is provided with a piston surface 19 which is acted upon by the system pressure p1. A central recess 20 (FIG. 2) is provided in the piston surface 19. In the starting position, therefore, the control piston 1 abuts with an annular surface surrounding the central recess 20 the projection 5 of the valve body 6.

At its opposite end, the control piston 1 is provided with another recess bore 21 which is significantly deeper than the central recess 20 at the opposite end. A pressure intensifying piston 23 abuts the bottom surface 22 of the recess bore 21. The pressure transferring or intensifying piston 23 has a smaller diameter than the control piston 1 and projects into a bore 24 of the housing 2. The system pressure p1 is intensified by the pressure 20 intensifying piston 23 creating the larger pressure p2 which acts on the injection valve 17.

The compression spring 15 abuts the bottom surface of a shoulder 25 at an end of the pressure intensifying piston 23. The compression spring 15 surrounds the pressure intensifying piston 23 and abuts with its other end (FIG. 1) the bottom 26 of a bore hole 27 of the housing 2, whereby this bore hole 27 receives the control piston 1.

When the internal combustion engine is operated the piston member 12 of the control valve 3 is displaced by means of the control unit 4 such that the hydraulic medium which is fed by a line 28 within the valve body 6 is pressurized. The hydraulic medium reaches the annular cavity 9 and acts with the system pressure p1 upon the piston surface 19 of the control piston 1. The recess bore 21 positioned opposite the piston surface 19 is relieved of pressure and is connected to the atmosphere by a bore opening 29 penetrating the housing 2. Due to this design, the control piston 1 can be displaced against the force of the compression spring 15. Thereby, the pressure intensifying piston 23 abutting the bottom surface 22 of the recess 21 is also displaced whereby the fuel within the bore 24 is pressed into a bore channel 31 by a fixedly connected distribution plate 30. The bore channel 31 is provided within an insertion member 32 which is received by a threaded socket member 33. The threaded socket member 33 is screwed onto the housing 2 and receives the injection valve 17 which projects out of the threaded socket member 33. The distribution plate 30 is clamped by means of the threaded socket member 33 between the insertion member 32 and the housing 2. The threaded socket member 33 extends under the insertion member 32 so that the insertion member 32 is pressed in the direction of the housing 2 when the threaded socket member 33 is screwed on.

The bore channel 31 extends from the distribution plate 30 through the insertion member 32 to an injection chamber 34 which is provided within the insertion member 32 and which is penetrated by the injection valve body 16. An axial bore 35 is provided, adjoining the injection chamber 34 and leading to the nozzle openings 18. The axial bore 35 has a larger diameter than the portion of the injection valve body 16 which projects into the axial bore 35. The injection valve body 16 projects into a central receiving cavity 36 of the insertion member 32. The central receiving cavity 36 is closed off at the opposite side by the distribution plate 30. One end of a second compression spring 37 is supported on the distribution plate 30 and its other end rests on a shoulder member 38. The shoulder member 38 is provided at the end portion of the injection valve body 16 that is positioned within the central receiving cavity 36 and has a central projection 39 for centering the second compression spring 37. The injection valve body 16 is axially guided with an enlarged portion 40 within the injection valve 17 and projects with this enlarged portion 40 into the injection chamber 34. Within the injection chamber 34 the enlarged portion 40 goes over into a thinner end portion 41.

The fuel reaching the injection chamber 34 by passing through the bore channel 31 exerts pressure upon the enlarged valve portion 40, whereby the injection valve body 16 is pushed back against the force of the second compression spring 37. The nozzle openings 18 are thus released from the injection valve body 16 so that the fuel can enter the combustion chamber.

Subsequent to the injection process, the piston member 12 is displaced by activating the control valve 3 by means of the control unit 4 in such a way as to relieve the pressure in the annular cavity 9 into the tank.

A back pressure valve 42 provided within the distribution plate 30 is opened up by the low pressure that is created during the return stroke of the pistons 1, 23, whereby fuel is taken in from a fuel container (not illustrated) through an opening 43 within the threaded socket member 33 and through an adjoining channel 44 within the insertion member 32. The fuel reaches the bore 24 via the distribution plate 30 so that the fuel can be conveyed to the nozzle openings 18 during the next stroke of the pressure intensifying piston 23 in the manner described. The channel 44 also opens into the central receiving cavity 36 of the insertion member 32.

With today's internal combustion engines, Diesel engines in particular, the injection process is performed by several individual injections in order to ensure a reliable and clean mixture formation within the combustion chamber. The injection processes are divided into pre-injection and main injection of the fuel quantity. In the fuel injection device described herein, the fuel amount to be injected, in particular the pre-injection quantity, is minimized at a minimum activation time of the control valve 3. For this purpose, an accumulator 62 is provided in the low pressure area The accumulator 62 does not at all affect the distribution of pressure of the main injection and, thus, the main injection quantity, or affects it only insignificantly. The accumulator 62 can, for example, be a piston-type accumulator, a membrane accumulator or a bubble accumulator. The accumulator capacity of these accumulators can, for example, be varied by an adjusting screw. In the illustrated embodiment, the accumulator 62 is arranged within the control piston 1 and has an intake valve 45 (FIG. 2) and a throttle 46. In the illustrated embodiment, the intake valve 45 is embodied as a ball valve, however, it can also be a plate valve, for example. The intake valve 45 is equipped with a valve ball 47 which stands under the pressure of a pressure spring 48 which is supported on a ring 49. The intake valve 45 and the throttle 46 are provided within a cover plate 50 which is attached, preferably soldered, in a receiving cavity 51 of the control piston 1. The diameter of the receiving cavity 51 is smaller than the diameter of the centrical recess 20 which is axially delimited by the cover plate 50. The intake valve 45 is provided within a valve bore 52 penetrating the cover plate 50 axially off-center. The ring 49 can be a threaded ring which is screwed into that end face of the cover plate 50 that lies opposite the central recess 20.

Under the force of a pressure coil spring 55, a piston 54 is supported via an axially projecting annular shoulder 53 on that surface of the cover plate 50 that faces away from the centrical recess 20. The pressure coil spring 55 is supported on the lower cavity bottom 56 of the receiving cavity 51 and on the upper cavity bottom 57 of a central recess cavity 58 which is provided at the end face 59 of the piston 54, whereby the end face lies opposite the annular shoulder 53. The external diameter of the annular shoulder 53 is smaller than the diameter of the receiving cavity 51. Because of the annular shoulder 53, an accumulating space 60 is formed between the cover plate 50 and the piston 54. The accumulating space 60 is connected to the central recess 20 in the low pressure area by the intake valve 45 and the throttle 46.

The receiving cavity 51 is connected to the recess bore 21 within the control piston 1 by at least one relieving bore 61 and it is connected to the atmosphere by the bore opening 29.

Figure 2:
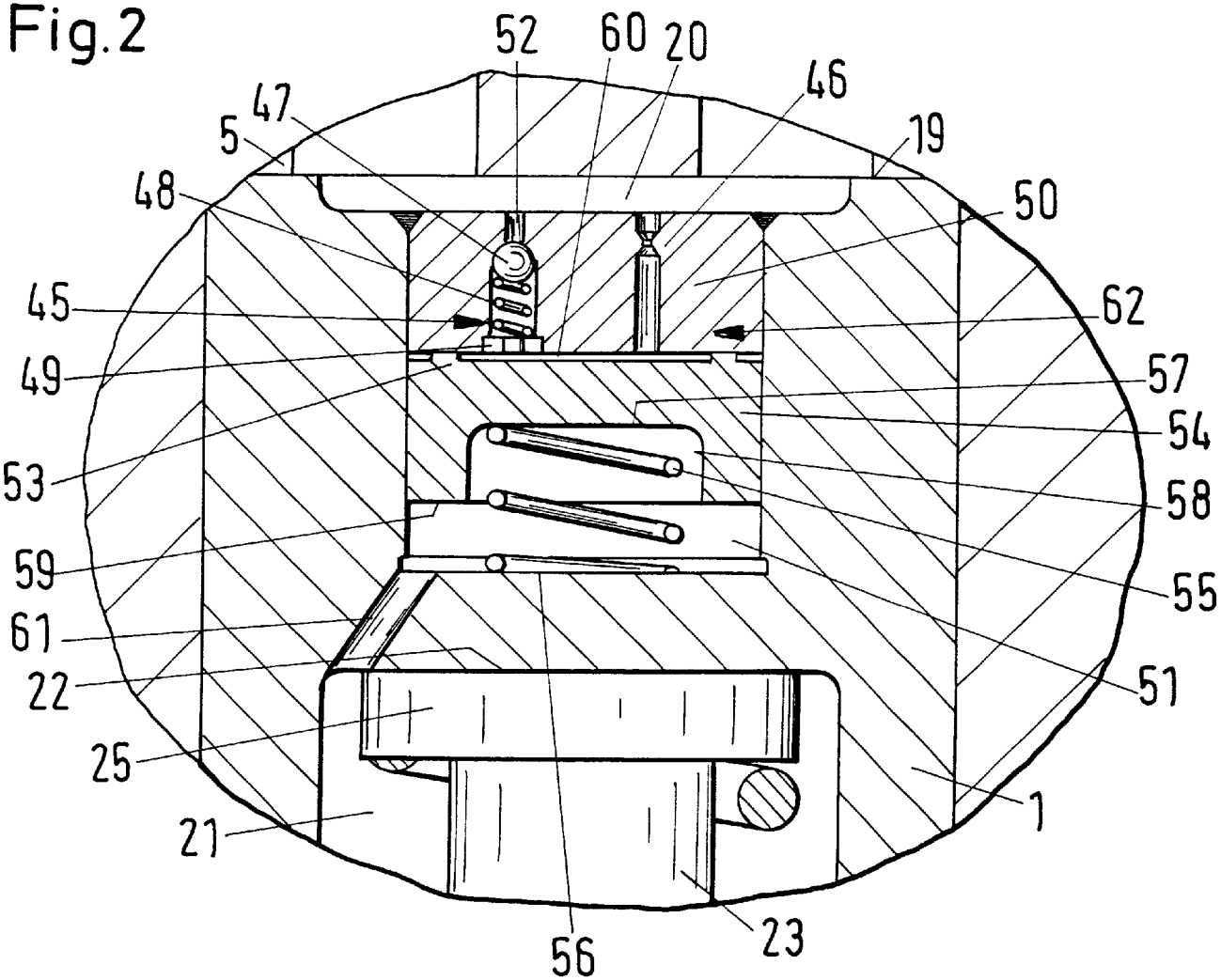
FIG. 2 shows an enlarged view of a longitudinal section of an inventive fuel injection device.
Figure 3:
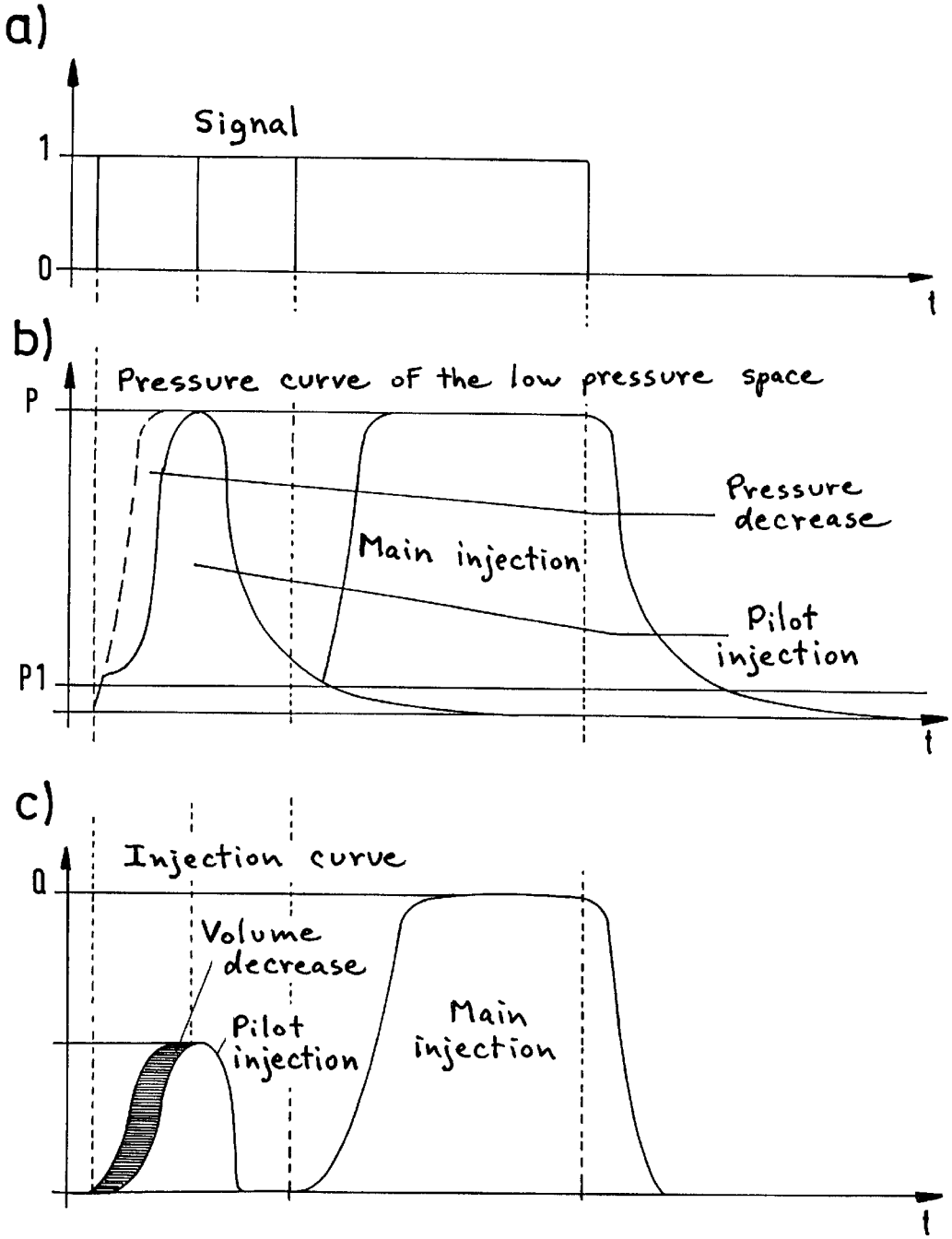
FIGS. 3*a* to FIG. 3*c* show various characteristic lines of the inventive fuel injection device.

The accumulator 62 described with the help of FIG. 2 is provided between the control valve 3 and the pressure intensifying piston 23. The system pressure pi is intensified by the pressure intensifying piston 23 to form the higher pressure p2 in the described manner by a control operation of the control valve 3, triggered by the control unit 4. The system pressure p1 is present in the centrical recess 20 which is connected to the annular cavity 9. When pressure acts upon the control piston 1, the control piston is displaced against the force of the compression spring 15, whereby the injection process is triggered in the described manner.

The force of the pressure spring 48 acting on the valve ball 47 is smaller than the system pressure p1 so that the intake valve 45 is opened upon displacement of the control piston 1 downwardly according to FIG. 1. Thereby, a portion of the hydraulic medium can enter the accumulating space 60 through the valve bore 52 which is now open. The piston 54 is, thus, also acted upon by the system pressure p1 so that it is displaced against the force of the pressure coil spring 55, whereby the capacity of the accumulating space 60 is accordingly enlarged.

When the injection process is terminated, the pressure within the annular cavity 9, and, thus, within the central recess 20 connected therewith, decreases. The compression spring 15 is designed such that it subsequently pushes the control piston 1 upwardly again into the starting position illustrated in FIG. 1 by acting on the pressure intensifying piston 23. During the process of pushing back the control piston 1, a pressure is created within the central recess 20 and within the annular cavity 9 whereby this pressure acts upon the intake valve 45 and keeps it open. Thereby, the piston 54 is held in its actuated position. This counter pressure acting upon the piston 54 can also be created by a throttle in the tank return of the control valve 3. When the pressure falls below a pressure level that is determined by the pressure coil spring 55, the accumulating space starts discharging. The accumulating volume can gradually escape the accumulating space through the throttle 46. The pressure coil spring 55 and the throttle 46 can be adjusted relative to each other such that a prescribed distribution of pressure within the low pressure space, namely, the central recess 20, can be adjusted. This distribution of pressure is adjusted such that the piston 54 is held in its position such that the volume within the accumulating space 60 is not reduced. The accumulating volume is not utilized on a subsequent main injection action so that the full pressure and, thus, the entire main injection quantity can immediately be conveyed.

In order that the subsequent injections are not negatively affected by the accumulator 62, the system is designed such that the discharge time of the accumulator 62 is always shorter than the shortest interval between two injection actions.

Figure 4:
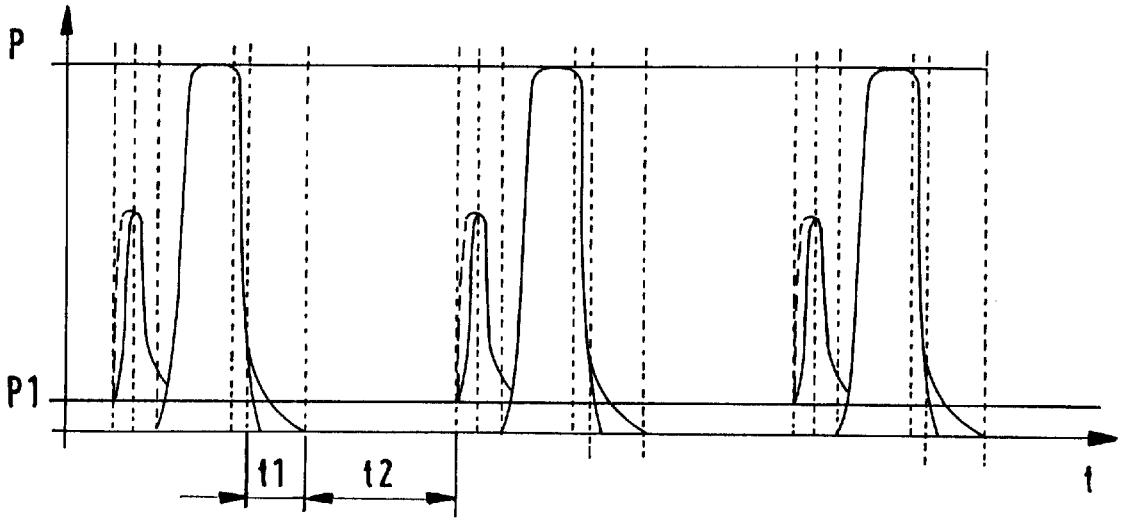
FIG. 4 shows a pressure-time-characteristic of the inventive fuel injection device.

FIG. 4 shows the pressure-dwell-curve of an injection process. It can be clearly observed that with each injection action, first a pre-, or pilot injection and, subsequently, a main injection occur. The maximum pressure during the pilot injection is lower than during the main injection. The time symbol t1 indicates the discharge time of the accumulator when the accumulator is discharged during the return movement of the control piston 1 into the position illustrated in FIG. 1. This discharge time t1 of the accumulator must in any event be shorter than the time interval t2 between two consecutive injection actions.

By providing the accumulator 62, it is achieved that the excessive amount for the pilot injection is conveyed into the accumulator which acts as a time function element.

FIG. 3*c* shows the injection flow in a flow-time-diagram. First, a small volume is required for the pilot injection. Subsequently, the larger injection amount required for the main injection is conveyed. Because of the presence of the accumulator 62, the fuel amount required for the pilot injection is reduced. This volume reduction is indicated in FIG. 3*c* by the hatched area.

FIG. 3*b* indicates the corresponding distribution of pressure within the low pressure space, while FIG. 3*a* shows the corresponding control signals of the control unit 4. FIG. 3*b* shows the distribution of pressure at low pressure with the pressure reduction and the distribution of pressure time-wise during the pilot and the main injection action. For initiating the pilot injection, a high-signal is emitted by the control unit 4 so that the hydraulic medium can be conveyed to the control piston 1, 23 by means of the control valve 3 in the manner described. After a pre-determined time period, the control unit 4 emits a low-signal, whereby the pilot injection is terminated. The pressure decreases accordingly until after a further time period t the control unit 4 again emits a high-signal in order to perform the main injection. For terminating the main injection, the signal is again set to low so that the control valve 3 is switched such that the pistons 1, 23 are guided back in the manner described into the starting position illustrated in FIG. 1.

With an appropriate selection of the pressure coil spring 55, the volume minimization by means of the accumulator 62 can also be designed such that the intake valve 45 can be omitted.

The conveying duration for the accumulator volume must be kept available for the entire conveying duration of the injection process. Any volume can be varied by a longer control signal emitted by the control unit 4. If the volume within the accumulator is selected to be larger than the minimum volume conveyed, any volume can be conveyed starting at zero.

If the force of the pressure coil spring 55 is selected to be larger than the opening force of the injection valve body 16, a reduced volume can be injected also during the time period until the accumulator 62 is entirely filled up.

With the device described herein, an injection quantity limitation can be achieved which, in comparison with the known methods for reducing the pilot injection quantity, has the energetic advantage that an energetic loss occurs only once in two successive injection actions, whereby the energetic loss has a damping effect on each injection process.

Due to the limitation of the injected fuel amounts, a variation of the pilot injection quantity is possible. This volume variation capacity ranges, depending on the adjustment of the accumulator 62, from a time-wise predetermined hydraulic intake amount to a reduced output amount without having an adverse effect on the subsequent main injection.

The accumulating capacity can be designed to be fixed, however, it can also be variable. Thus, variable quantities of hydraulic medium can be received within the accumulating space 60. The device described herein can be arranged within the injector, as is illustrated in the embodiment. However, it is also possible to provide it externally of the injector.

The present invention is, of course, in no way restricted to the specific disclosure of the specification and drawings, but also encompasses any modifications within the scope of the appended claims.

What is claimed is:

1. A fuel injection device for internal combustion engines comprising:

a housing means having at least one channel;

a control piston provided within said housing means;

at least one control valve that is disposed on said housing, whereby a control valve displaces said control piston by means of a pressure medium for conveying fuel via said at least one channel in the direction of a combustion chamber of said internal combustion engine; and at least one accumulator for said pressure medium disposed in a flow direction of said pressure medium, whereby said accumulator is provided within said control piston, and wherein said accumulator is provided with a biased accumulator piston.

2. A fuel injection device according to claim 1, wherein said accumulator is displaceably arranged within said control piston.

3. A fuel injection device according to claim 2, wherein said accumulator piston is displaceable against a spring force.

4. A fuel injection device according to claim 1, wherein said accumulator is provided with a cover plate which, in conjunction with said accumulator piston, delimits an accumulating space.

5. A fuel injection device according to claim 4, wherein said accumulating space is connected by at least one throttle to a line for feeding said pressure medium to said accumulating space.

6. A fuel injection device according to claim 5, wherein said throttle is arranged within said cover plate.

7. A fuel injection device according to claim 5, wherein said accumulating space is connected to said line for said pressure medium by at least one intake valve which opens up into said accumulating space.

8. A fuel injection device according to claim 7, wherein said intake valve is provided within said cover plate.

9. A fuel injection device according to claim 4, wherein said cover plate is mounted within said control piston.

10. A fuel injection device according to claim 9, wherein said accumulator piston is provided with an annular shoulder for resting against said control piston.

11. A fuel injection device according to claim 1, which includes means for adjusting a pressure acting on a capacity of said accumulator.

12. A fuel injection device according to claim 1, wherein said control valve is connected to a control unit.

13. A fuel injection device according to claim 1, wherein said piston has a receiving cavity for receiving said accumulator piston and wherein said receiving cavity is vented to the outside.

14. A fuel injection device according to claim 1, wherein said control piston acts upon a pressure intensifying piston.

15. A fuel injection device according to claim 14, wherein said pressure intensifying piston conveys fuel in a direction of nozzle openings.

16. A fuel injection device according to claim 14, wherein said accumulator is arranged at a surface of said control piston, wherein said surface lies opposite said pressure intensifying piston.

* * * * *